US009116500B2

(12) United States Patent
Ito

(10) Patent No.: US 9,116,500 B2
(45) Date of Patent: Aug. 25, 2015

(54) IMAGE FORMING APPARATUS HAVING TWO HOUSINGS AND METHOD FOR ASSEMBLING THE SAME

(71) Applicant: Sakae Ito, Kitanagoya (JP)

(72) Inventor: Sakae Ito, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 100 days.

(21) Appl. No.: 13/851,146

(22) Filed: Mar. 27, 2013

(65) Prior Publication Data

US 2013/0287433 A1 Oct. 31, 2013

(30) Foreign Application Priority Data

Apr. 27, 2012 (JP) ..... 2012-102503

(51) Int. Cl.
*G03G 21/16* (2006.01)

(52) U.S. Cl.
CPC ..... *G03G 21/1619* (2013.01); *G03G 21/1628* (2013.01); *G03G 21/1647* (2013.01); *G03G 2221/1687* (2013.01); *Y10T 29/49002* (2015.01)

(58) Field of Classification Search
CPC ..... G03G 21/1628; G03G 21/1633; G03G 2221/1687; G03G 2221/169; G03G 21/1619
USPC ..... 399/107, 124, 125, 380; 347/108, 152, 347/263; 312/223.2
See application file for complete search history.

(56) References Cited

U.S. PATENT DOCUMENTS

| | | | | |
|---|---|---|---|---|
| 7,369,794 | B2 * | 5/2008 | Kawai et al. | 399/125 |
| 7,680,431 | B2 * | 3/2010 | Ikebata | 399/107 |
| 7,689,050 | B2 | 3/2010 | Sakaue | |
| 7,778,572 | B2 * | 8/2010 | Iijima | 399/125 |
| 7,804,628 | B2 * | 9/2010 | Hashimoto et al. | 358/494 |
| 7,822,362 | B2 | 10/2010 | Watanabe et al. | |
| 7,873,303 | B2 * | 1/2011 | Ohta et al. | 399/125 |
| 7,957,675 | B2 * | 6/2011 | Iijima | 399/125 |
| 8,611,784 | B2 * | 12/2013 | Uchida | 399/110 |
| 8,699,919 | B2 * | 4/2014 | Takamori | 399/125 |
| 2007/0071334 | A1 | 3/2007 | Sakaue | |
| 2009/0018899 | A1 | 1/2009 | Ogushi et al. | |
| 2009/0252527 | A1 | 10/2009 | Watanabe et al. | |

FOREIGN PATENT DOCUMENTS

| | | | |
|---|---|---|---|
| JP | 2006-184530 | A | 7/2006 |
| JP | 2006-295625 | A | 10/2006 |
| JP | 2008-304748 | A | 12/2008 |
| JP | 2009-020672 | A | 1/2009 |
| JP | 2009-251230 | A | 10/2009 |

* cited by examiner

*Primary Examiner* — Robert Beatty

(74) *Attorney, Agent, or Firm* — Banner & Witcoff, Ltd.

(57) ABSTRACT

An image forming apparatus includes a first housing, a second housing pivotable relative to the first housing in such a manner as to be located to an open position and a close position, a slider provided in one of the first and second housings configured to be slidable relative to the one in a slide moving direction, a connecting portion provided in the other of the housings; an arm member configured to connected each of the slider and the connecting portion to be pivotable relative to each of them, and an elastic member comprising a first engaging portion engaging with the slider and a second engaging portion engaging with the one of the housings. The elastic member applies, to the slider, a force in a direction in which the slider moves closer to the connecting portion, when the second housing is in the close position.

20 Claims, 11 Drawing Sheets

IMAGE FORMING APPARATUS HAVING TWO HOUSINGS AND METHOD FOR ASSEMBLING THE SAME

CROSS REFERENCE TO RELATED APPLICATION

The present application claims priority from Japanese Patent Application No. 2012-102503, which was filed on Apr. 27, 2012, the disclosure of which is herein incorporated by reference in its entirety.

BACKGROUND OF THE INVENTION

1. Field of the Invention

The present invention is related to an image forming apparatus that employs an electronic photographic type.

2. Description of Related Art

There is known, as an image forming apparatus of the electronic photographic type, a printer having a photoreceptor configured to carry a developer image, and a developing unit configured to supply a developer to the photoreceptor, in a main body of the apparatus.

For example, there is known a printer having an opening portion for maintaining the photoreceptor and the developing unit, and a supporting member for covering and uncovering the opening portion, at an upper face of the main body.

This printer is constructed such that the opening portion is covered when the supporting member is in a close state in which the supporting member is close to the main body, and the opening portion is uncovered when the supporting member is in a separate state in which the supporting member is separate from the main body.

Additionally, the printer also includes: an arm configured to keep the supporting member in the separate state in which the supporting member has been uprisen relative to the main body; and an arm spring provided between an intermediate portion of the arm and the supporting member, and the arm spring applies a force to the arm so as to be uprisen.

SUMMARY OF THE INVENTION

Accordingly, in an assembling of the above printer, firstly, the supporting member is attached to the main body, and then the arm is attached to the main body and the supporting member while the supporting member is kept in the separate state, and next, respective ends of the arm spring are attached to the intermediate portion of the arm and the supporting member.

In other words, the arm spring is pulled (displaced) and attached to the intermediate portion of the arm and the supporting member while the supporting member is kept in the separate state in an assembling process of the printer.

However, since the arm spring generates a force sufficient to keep the supporting member in the separate state by way of the arm, it requires a labor to pull the arm spring against its spring force and then attach the arm spring to the arm and the supporting member. Therefore, there is a defect that an assembly work of the printer is troublesome.

It is an object of the present invention to provide an image forming apparatus capable of facilitating the assembly work.

The object may be achieved according to the present invention which provides an image forming apparatus including: a first housing; a second housing configured to be pivotable relative to the first housing to be located to an open position and a close position; a slider comprising a slider connecting portion, provided in one of the first housing and the second housing configured to be slidable relative to the one of the first housing and the second housing in a slide moving direction; a connecting portion provided in the other of the first housing and the second housing; an arm member comprising an arm connecting portion, configured to be connected each of the slider and the connecting portion to be pivotable relative to each of the slider and the connecting portion, the arm connecting portion being connected to the slider connecting portion; and an elastic member comprising a first engaging portion engaging with the slider and a second engaging portion engaging with the one of the first housing and the second housing, wherein the elastic member is configured to apply, to the slider, a force in a direction in which the slider moves closer to the connecting portion along the slide moving direction in which the slider slidingly moves, when the second housing is in the close position.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 3A and 3B are perspective views of the printer in FIG. 1 from an upper left viewpoint at a time when the support frame is in an open position, wherein FIG. 3A is the perspective view of a whole of the printer, and FIG. 3B is a magnified perspective view of a part encircled by a dotted line in FIG. 3A;

FIGS. 4A and 4B are views of a pivot frame shown in FIG. 3A when the support frame is in the close position, wherein FIG. 4A is a perspective view from an upper right viewpoint, and FIG. 4B is a side view from a right viewpoint;

FIGS. 5A and 5B are views of the pivot frame shown in FIG. 3A at a time when the support frame is between the close position and the open position, wherein FIG. 5A is a perspective view from an upper right viewpoint, and FIG. 5B is a side view from a right viewpoint;

FIGS. 6A and 6B are views of the pivot frame shown in FIG. 3A at a time when the support frame is in the open position, wherein FIG. 6A is a perspective view from an upper right viewpoint, and FIG. 6B is a side view from a right viewpoint;

FIGS. 7A-7C are bottom views of a slider shown in FIGS. 4A and 4B for illustrating a slide movement of the slider, wherein FIG. 7A shows a state of the slider at a time when the support frame is in the open position, FIG. 7B shows a state of the slider at a time when the support frame is between the close position and the open position, and FIG. 7C shows a state of the slider at a time when the support frame is in the close position;

FIGS. 8A-8C are top views of the slider shown in FIGS. 4A and 4B for illustrating the slide movement of the slider, wherein FIG. 8A shows the state of the slider at the time when the support frame is in the open position, FIG. 8B shows the state of the slider at the time when the support frame is between the close position and the open position, and FIG. 8C shows the state of the slider at the time when the support frame is in the close position;

DETAILED DESCRIPTION OF THE PREFERRED EMBODIMENTS

1. General Structure of Printer

Figure 1:
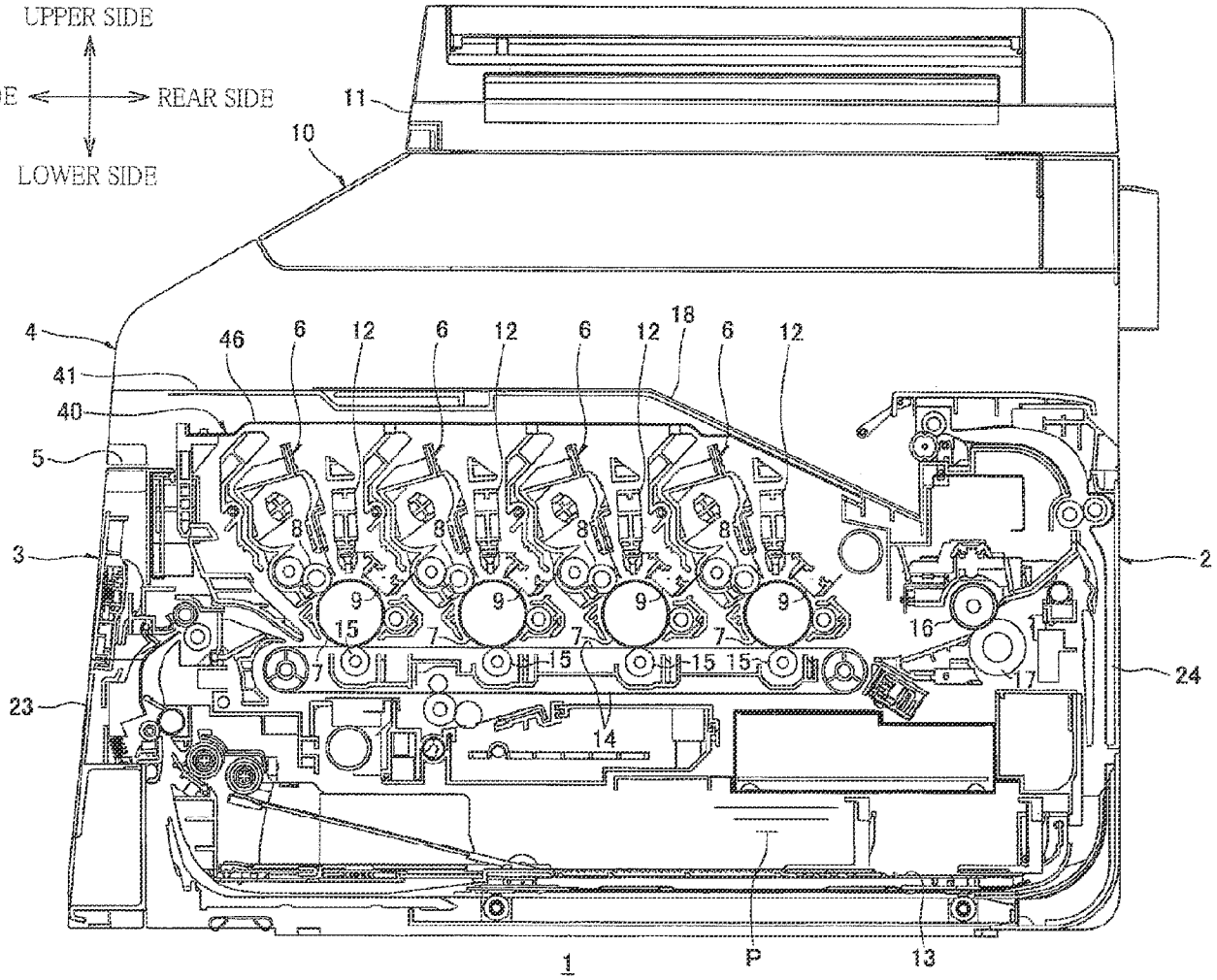
FIG. 1 is a cross-sectional view showing a printer as one embodiment of an image forming apparatus according to the present invention.

As shown in FIG. 1, a printer 1 as an example of an image forming apparatus, includes a main body casing 2, and an image reading unit 10 provided above the main body casing 2 and configured to scan image information on an image recorded sheet. That is, the printer 1 is a multifunction peripheral incorporating the image reading unit 10.

It is noted that a state in which the printer 1 is horizontally placed is set as a reference in the following description, and thus, on a drawing sheet of FIG. 1, a left side is a front side of the printer 1 while a right side is a rear side of the printer 1. Additionally, a left side and a right side of the printer 1 are defined in a front view of the printer 1. That is, a top surface side of the drawing sheet of FIG. 1 is the right side of the printer 1 while a back surface side of the drawing sheet of FIG. 1 is the left side of the printer 1.

Figure 2:
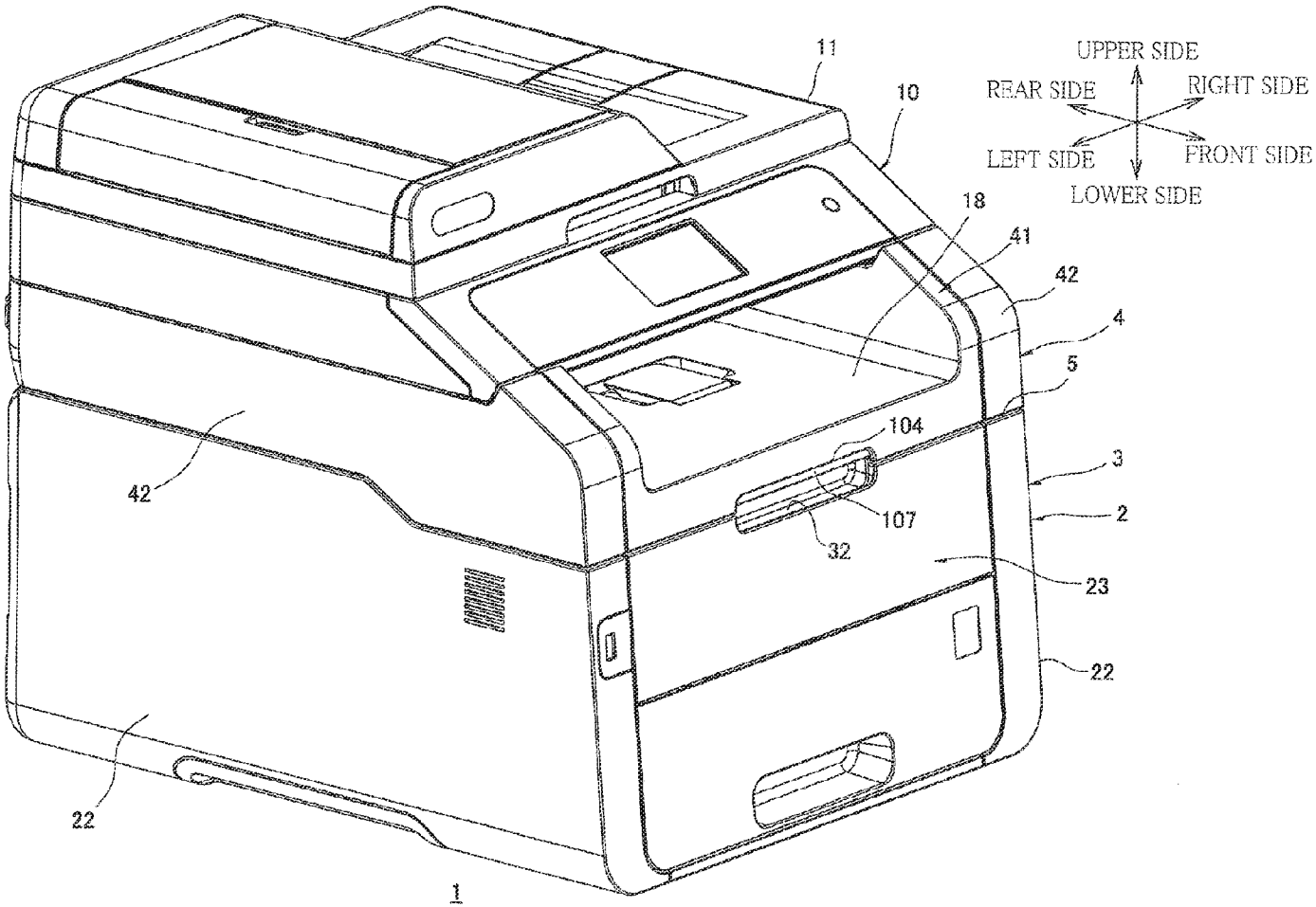
FIG. 2 is a perspective view of the printer in FIG. 1 from an upper left viewpoint at a time when a support frame is in a close position.

The main body casing 2 has an almost box-like shape looking like an almost rectangular shape in a side view, as shown in FIGS. 1 and 2. The main body casing 2 has a main body frame 3 as an example of one of a first housing and a second housing, and a support frame 4 as an example of the other of the first housing and the second housing.

Figure 3A:
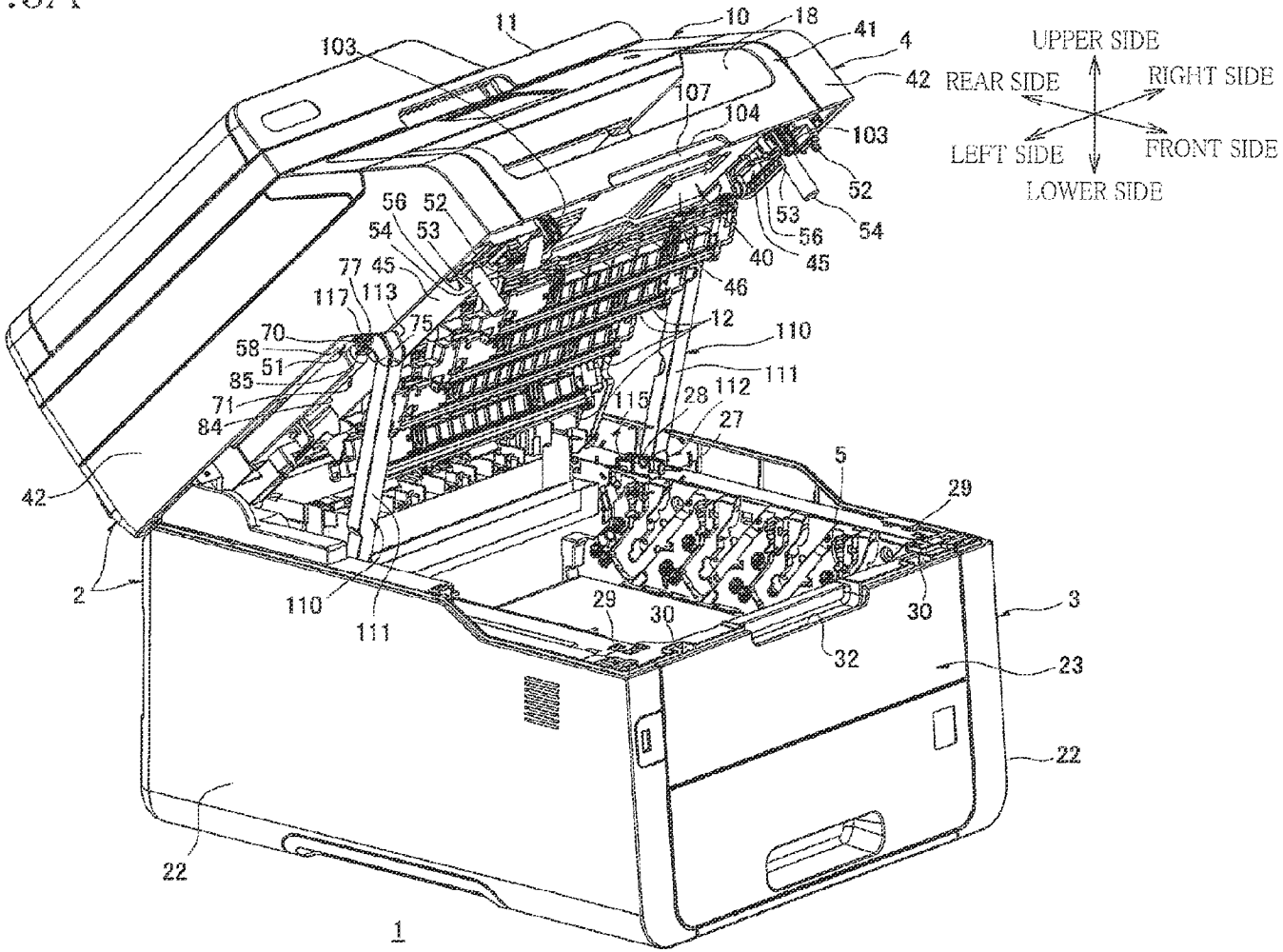

The main body frame 3 is a lower portion of the main body casing 2, as shown in FIG. 3A, and has an almost box-like shape being open upward.

A top portion of the main body frame 3 is defined as a main body opening portion 5 as an example of an opening portion.

The main body opening portion 5 allows an inside to be open to an outside of the main body frame 3 in an up-down direction.

The support frame 4 is an upper portion of the main body casing 2, as shown in FIG. 2, and has an almost rectangular shape in a side view extending in a front-rear direction. The support frame 4 is also configured to have a pivot point at a rear end portion of the support frame 4 and to be pivotable relative to the main body frame 3, as shown in FIGS. 2 and 3A. That is, the support frame 4 has a pivotal portion 50 at the rear end portion of the support frame 4 as the pivot point around which the support frame 4 can pivot. Then, the support frame 4 is configured to pivot to an open position in which the main body opening portion 5 is uncovered (see FIG. 3A) and a close position in which the main body opening portion 5 is covered (see FIG. 2).

That is, the support frame 4 is configured to serve as a cover that covers and uncovers the main body opening portion 5.

It is noted that a following description of the general structure of the printer 1 is explained in a state in which the support frame 4 is in the close position (see FIGS. 1 and 2).

The printer 1 further includes, as shown in FIG. 1, process cartridges 6 each as an example of a cartridge and LED units 12 each of which is an example of an exposure, in the main body casing 2.

The process cartridges 6 are constituted by four process cartridges 6 that correspond to respective colors, that is, black, yellow, magenta, and cyan. The four process cartridges 6 are arranged in the front-rear direction with a space provided between adjacent each two of the four process cartridges 6. The process cartridges 6 are accommodated in the main body frame 3 such that the process cartridges 6 are detachable from the main body frame 3 through the main body opening portion 5 while the support frame 4 is in the open position (see FIG. 3A).

Additionally, each of the process cartridges 6 has a photoconductive drum 7, a developing roller 8, and a charging device 9.

The photoconductive drum 7 is rotatably supported by a lower portion of the process cartridge 6 such that an upper side and a lower side of the photoconductive drum 7 are exposed. The developing roller 8 is rotatably supported by the process cartridge 6 in such a manner as to be in contact with an upper front portion of the photoconductive drum 7. The charging device 9 is supported by the process cartridge 6 in such a manner as to face to an upper rear portion of the photoconductive drum 7 with a space provided between the charging device 9 and the photoconductive drum 7.

Each of the LED units 12 is supported by a lower face of the support frame 4 in such a manner as to face to a top portion of the photoconductive drum 7 with a space provided between the LED unit 12 and the photoconductive drum 7 (see FIG. 1).

Additionally, each of the process cartridges 6 accommodates a toner above the corresponding developing roller 8.

The toner in the process cartridge 6 is charged positively, and is carried by a surface of the developing roller 8 as a thin layer having a constant thickness.

On the other hand, a surface of the photoconductive drum 7 is uniformly charged by the charging device 9, and is then exposed by the LED unit 12 based on a set specific image data. Consequently, an electrostatic latent image based on the set specific image data is formed on the surface of the photoconductive drum 7. Then, the toner carried by the developing roller 8 is supplied to the electrostatic latent image on the surface of the photoconductive drum 7, whereby a toner image is held on the surface of the photoconductive drum 7.

Paper sheets P are accommodated in a sheet supplying tray 13 provided in a bottom portion of the main body frame 3. The paper sheets P are conveyed one by one at a predetermined timing. Each of the paper sheets P is U-turned toward an upper rear portion of the printer 1, so as to be supplied between the photoconductive drum 7 and a conveyance belt 14. Afterward, the paper sheet P is conveyed by the conveyance belt 14 from a front side to a rear side so as to sequentially face to all of the photoconductive drums 7. At the same time, the toner image held on the photoconductive drum 7 is transferred to the paper sheet P by a transcription bias of a transcription roller 15 disposed below the photoconductive drum 7 such that the conveyance belt 14 is interposed between the transcription roller 15 and the photoconductive drum 7 which are opposite to each other.

Next, when the paper sheet P passes between a heated roller 16 and a pressure roller 17, the paper sheet P is heated and pressed. This heat-fixes the toner image on the paper sheet P.

Finally, the paper sheet P is U-turned and conveyed toward an upper front portion of the printer 1 to be discharged to a sheet discharged tray 18 provided on an upper face of the support frame 4.

2. Main Body Frame

As shown in FIG. 3A, the main body frame 3 includes a pair of side walls 22 disposed in such a manner as to face to each other with a space interposed therebetween in a left-right direction, a front wall 23 connected to a front portion of each of the side walls 22, and a rear wall 24 (see FIG. 1) connected to a rear portion of each of the side walls 22.

Figure 4A:
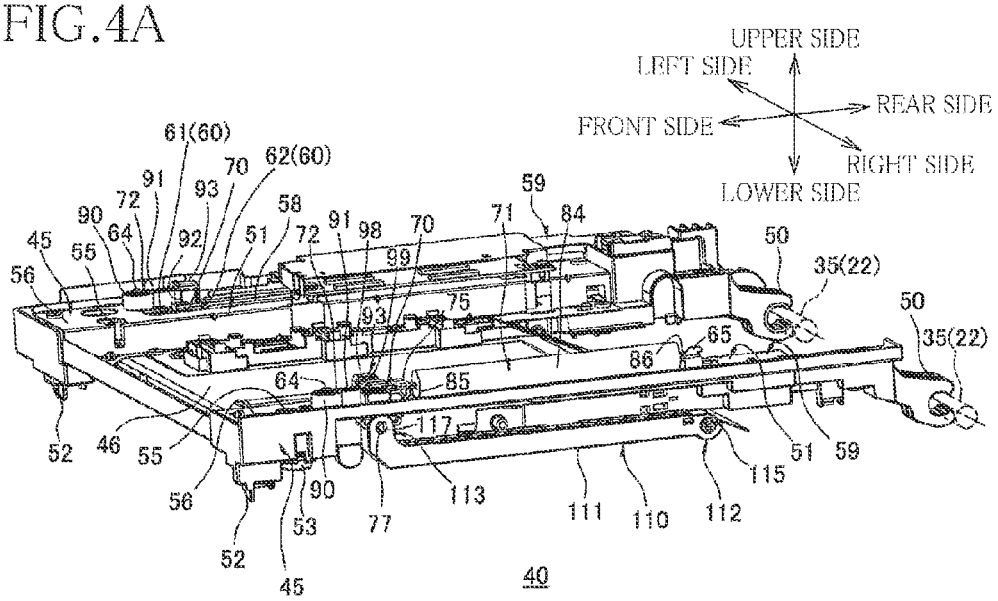
Figure 4B:
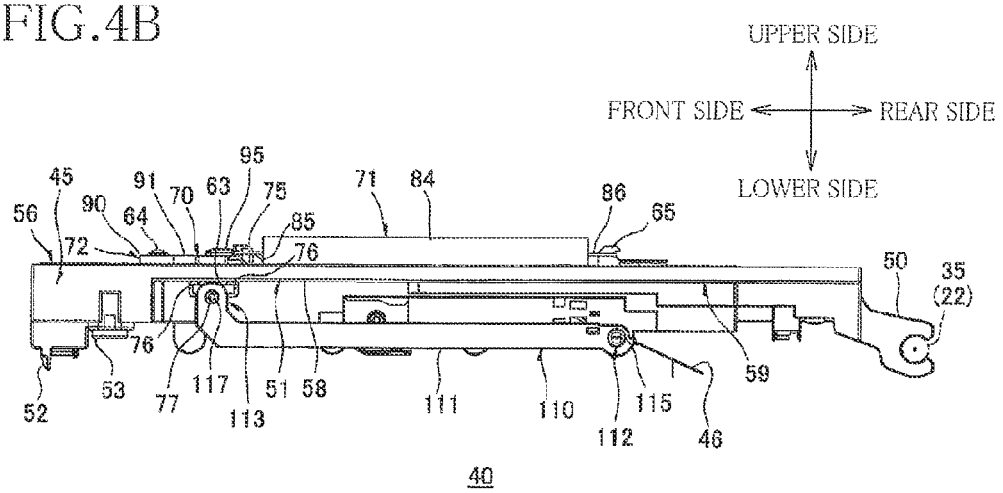

Each of the side walls 22 constituting the pair has an almost flat plate-like shape having a thickness in the left-right direction, and has an almost rectangular shape extending in the front-rear direction in a side view. Each of the side walls 22 has a pivotal shaft 35, as shown in FIGS. 4A and 4B.

The pivotal shaft 35 has an almost column shape extending in the left-right direction, and is supported by a upper rear end portion of each of inner faces of the side walls 22 in the left-right direction (see FIG. 3A).

Additionally, each of the side walls 22 is provided with a position-determining recessed portion 29, and a main body connecting portion 27 as an example of a connecting portion.

The position-determining recessed portion 29 is disposed in a front end portion of an upper face of the side wall 22. The position-determining recessed portion 29 has an almost rectangular shape in a plan view, and is recessed downward from the upper face of the side wall 22.

The main body connecting portion 27 is disposed in the rear of the position-determining recessed portion 29 and almost at a center portion of the side wall 22 in the front-rear direction. The main body connecting portion 27 has an almost flat plate-like shape and protrudes from the inner face of the side wall 22 in the left-right direction. And the main body connecting portion 27 has a through hole 28 extending in the left-right direction almost at a center portion of the main body connecting portion 27. The through hole 28 has an almost circular shape in a side view.

It is noted that the side wall 22 has portions facing to the respective through holes 28 in the left-right direction, and each of these portions has a groove (not shown) having an almost circular shape in a side view and recessed outward in the left-right direction.

The front wall 23 has an almost flat plate-like shape having a thickness in the front-rear direction. Fitting recessed portions 30 and a receiving recessed portion 32 are provided on an upper face of the front wall 23.

The fitting recessed portions 30 are disposed at respective one of opposite end portions on the upper face of the front wall 23. Each of the fitting recess portions 30 has an almost rectangular shape in a plan view, and is recessed downward from the upper face of the front wall 23.

The receiving recess portion 32 is disposed between the two fitting recess portions 30 and formed almost at a central portion of the upper face of the front wall 23 in the left-right direction. The receiving recess portion 32 has an almost U-shape in a front view, and is recessed downward from the upper face of the front wall 23. The receiving recess portion 32 is open forward, because a front edge portion of the front wall 23 corresponding to the receiving recess portion 32 is cut out.

3. Support Frame

The support frame 4 includes a pivotal frame 40, a tray member 41, and a pair of side covers 42, as shown FIG. 3A.

(1) Pivoting Frame

As shown in FIGS. 4A and 413, the pivotal frame 40 includes a pair of frame side walls 45 disposed in such a manner as to face to each other with a space interposed therebetween in a left-right direction, and a bridge plate 46 connected to an inner face of each of the frame side walls 45 facing to each other in the left-right direction.

Each of the frame side walls 45 constituting the pair has an almost beam-like shape extending in the front-rear direction.

The bridge plate 46 has an almost flat plate-like shape, as shown in FIG. 4A. Specifically, a portion of five-sixth of the bridge plate 46 starting from a front periphery of the bridge plate 46 in the front-rear direction extends horizontally, and a rest portion of the bridge plate 46 (one-sixth of the bridge plate 46 in the front-rear direction) is inclined in such a manner as to extend rearward and downward.

A length of the bridge plate 46 in the front-rear direction is shorter than a length of each of the frame side walls 45. The bridge plate 46 connects the respective inner surfaces of the frame side walls 45 such that a front edge of the bridge plate 46 is nearly flush with a front face of each of the frame side walls 45.

Each of the frame side walls 45 comprises the pivotal portion 50 and a rail formed portion 51.

The pivotal portion 50 has an almost C-shape being open rearward in a side view. A front end portion of the pivotal portion 50 is connected with a rear edge of the frame side wall 45. The pivotal portion 50 is rotatably fitted on an outside of the pivotal shaft 35 provided at the rear wall 24 of the main body frame 3. This is described later in detail.

Each of the rail formed portions 51 has an almost flat plate-like shape. The rail formed portions 51 protrude outward in the left-right direction from respective outer edges of upper faces of the frame side walls 45 in the left-right direction.

The rail formed portion 51 is divided into three portions in the front-rear direction. Specifically, the rail formed portion 51 is divided into a damper hole formed portion 56, a rail portion 58, and a hook support portion 59 as an example of an extending portion.

The damper hole formed portion 56 is a portion of approximately one-seventh of the rail formed portion 51 starting from a front end portion of the rail formed portion 51. A damper hole 55 is formed at an outer portion of the damper hole formed portion 56 in the left-right direction.

The damper hole formed portion 56 also has a position-determining protrusion portion 52 and a damper cylinder 53, as shown in FIG. 4A.

The position-determining protrusion portion 52 is provided to correspond to the position-determining recessed portion 29. And the position-determining protrusion portion 52 has an almost rectangular shape in a side view and protrudes downward from a front end portion of a bottom face of the damper hole formed portion 56.

The damper cylinder 53 is disposed in the rear of the position-determining protrusion portion 52, as shown in FIG. 3, and has an almost hollow cylindrical shape extending downward from a circumferential portion of the damper hole 55.

Figure 8A:
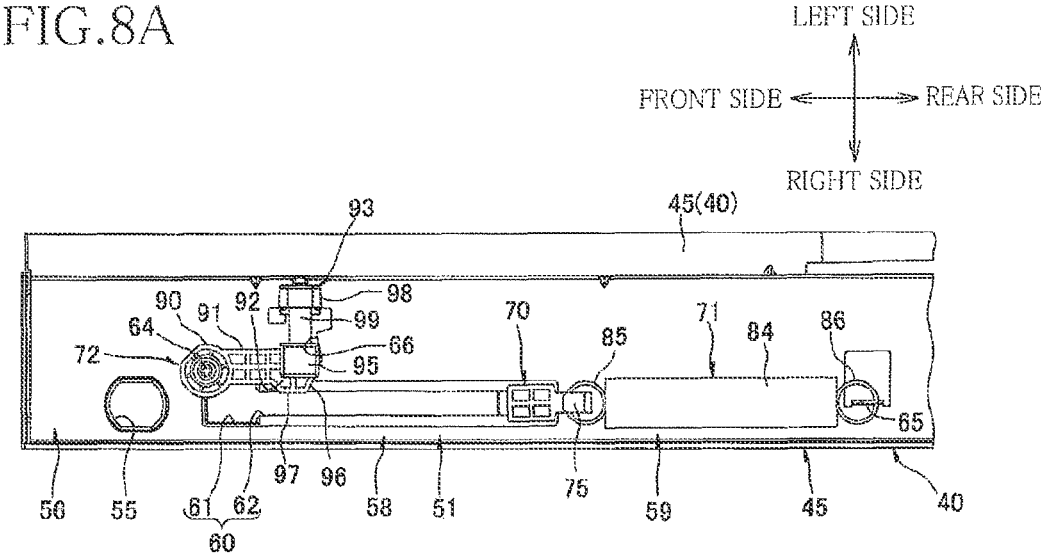
Figure 8B:
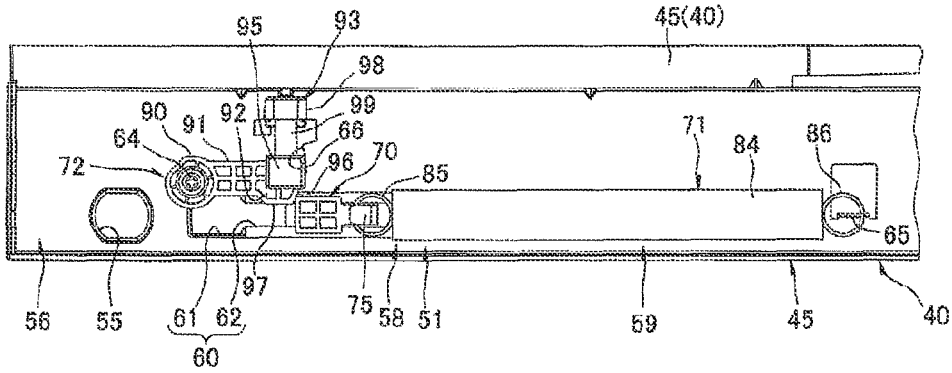
Figure 8C:
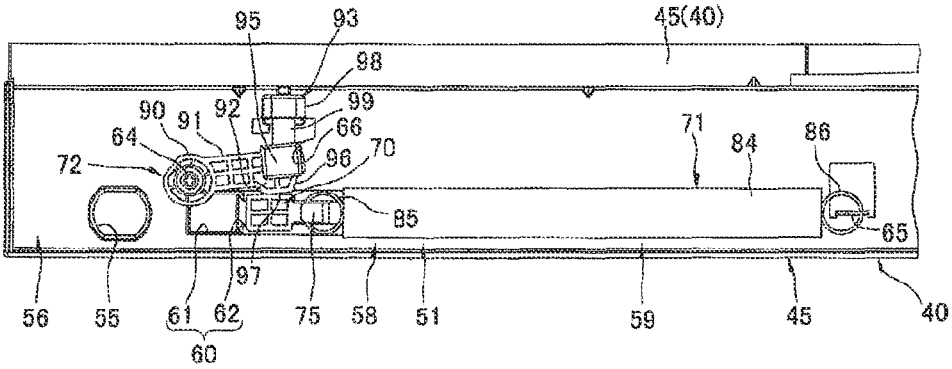

The rail portion 58 is a portion of approximately one-half of the rail formed portion 51 starting from a rear end portion of the damper hole formed portion 56, as shown in FIGS. 8A-8C. A slide guiding hole 60 and a lock guide hole 66 are formed in the rail portion 58.

The slide guiding hole 60 is a through hole of the rail formed portion 51 extending in the up-down direction, and is formed at an outer portion of the rail portion 58 in the left-right direction. The slide guiding hole 60 has an almost rectangular shape in a plan view extending in the front-rear direction. The slide guiding hole 60 is also constituted by a receiving hole 61 and a rail hole 62.

The receiving hole 61 is a front portion of the slide guiding hole 60, and has an almost rectangular shape in a plan view. A width of the receiving hole 61, that is, a length of the receiving hole 61 in the left-right direction is longer than a length of a slider 70 in the left-right direction.

The rail hole 62 is a rear portion of the slide guiding hole 60, and is united with the receiving hole 61 at a rear edge portion of the receiving hole 61. The rail hole 62 has an almost rectangular shape in a plan view extending rearward. A width of the rail hole 62, that is, a length of the rail hole 62 in the left-right direction is shorter than the length of the receiving hole 61 in the left-right direction.

The lock guide hole 66 is formed, as shown in FIG. 8B, at a left side of a front end portion of the rail hole 62 in the rail portion 58 and away from the rail hole 62. The lock guide hole 66 has an almost arc shape. A rotation axis of a lock shaft 64 (described later) passes through a center of the arc shape.

Each of restricting protrusions 63 (FIGS. 7A-7C) and the lock shaft 64 (FIGS. 8A-8C) are integrally formed on the rail portion 58. Each of the restricting protrusions 63 (FIGS. 7A-7C) constitute an example of a restricting mechanism.

Figure 7A:
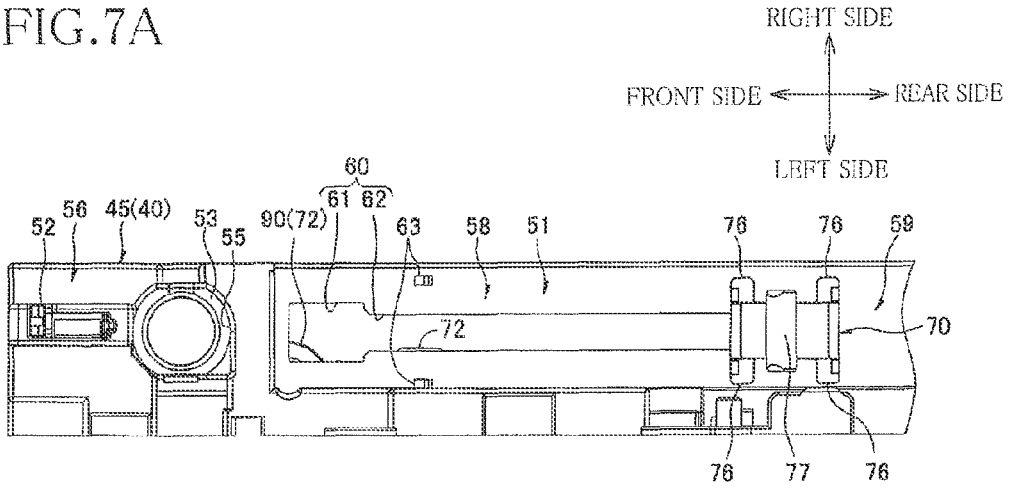
Figure 7B:
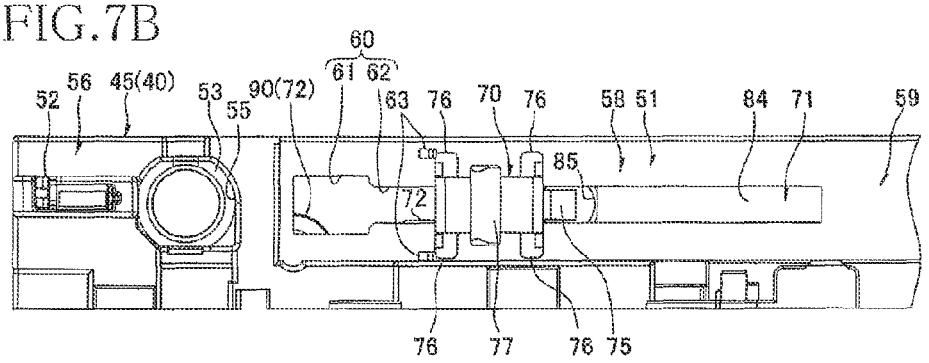
Figure 7C:
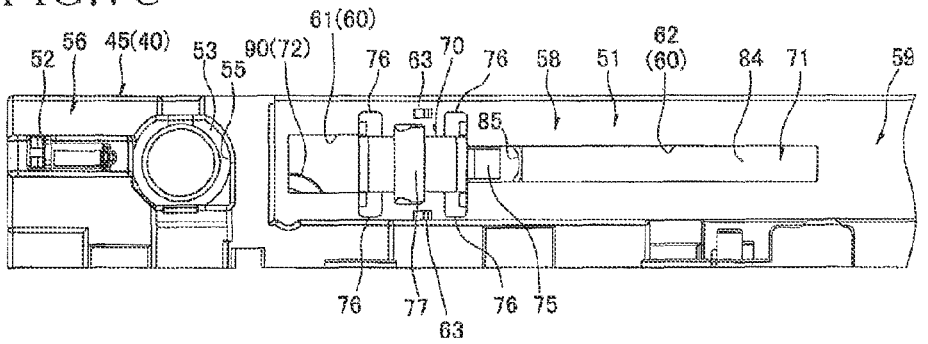
Figure 9:
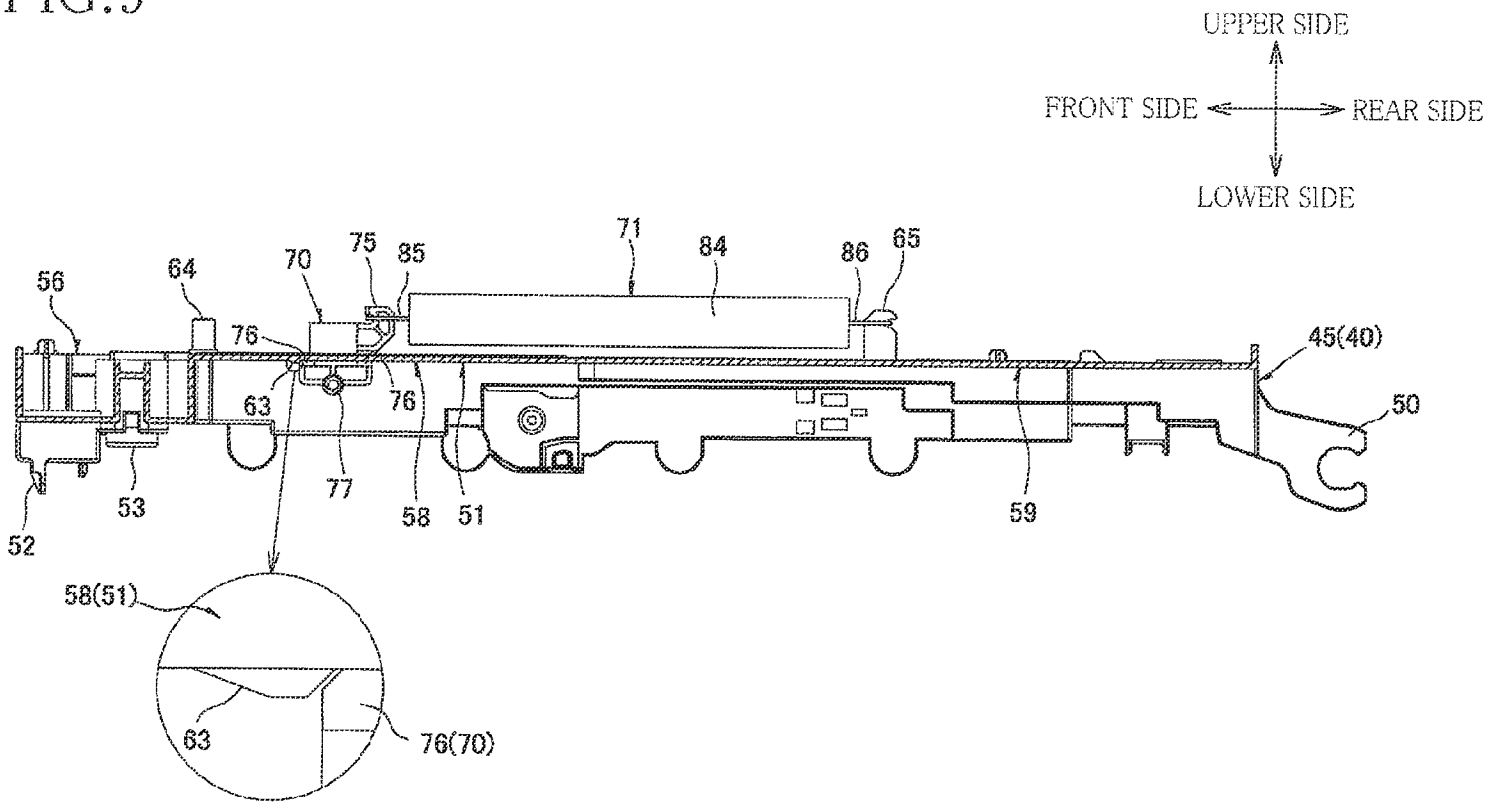
FIG. 9 is a side cross-sectional view of a frame side wall shown in FIGS. 4A and 4B.

As shown in FIGS. 7A-7C, the restricting protrusions 63 are integrally formed on a bottom face of the rail portion 58, at both sides of the front end portion of the rail hole 62 in the left-right direction. Specifically, the restricting protrusions 63 constitute a pair, and are disposed away from respective both edges of the rail hole 62 in the left-right direction. As shown in FIG. 9, each of the restricting protrusions 63 has an almost triangular shape in a side view and protrudes downward from the bottom face of the rail portion 58. Additionally, a bottom face of each of the restricting protrusions 63 extends rearward and downward in a portion of approximate four-seventh of the restricting protrusion 63 starting from a front end portion thereof, further extends rearward in a portion of approximate one-seventh of the restricting protrusions 63, and then extends rearward and upward in a portion of approximate two-seventh of the restricting protrusions 63. In other words, as an imaginary point on the bottom face of the portion of approximate four-seventh of the restricting protrusion 63 moves rearward from a front end of the restricting protrusion 63, the imaginary point moves downward. Then, as the imaginary point on the bottom face of the portion of approximate one-seventh of the restricting protrusion 63 further moves rearward, the imaginary point does not move downward and upward (horizontally moves). Moreover, as the imaginary point on the bottom face of the portion of approximate two-seventh of the restricting protrusion 63 further moves rearward, the imaginary point move upward. That is, each of the restricting protrusions 63 has a shape whose front portion has a bottom face inclined downward with a small angle relative to the bottom face of the rail portion 58 and whose rear portion has a bottom face inclined downward with a larger angle than the front portion. That is, the bottom face of the front portion of the restricting protrusion 63 is an example of a first inclined face, and the bottom face of the rear portion of the restricting protrusion 63 is an example of a second inclined face.

As shown in FIG. 8A, the lock shaft 64 is formed on an upper face of the rail portion 58, inside the front end portion of the receiving hole 61 in the left-right direction. As shown in FIG. 9, the lock shaft 64 has an almost column shape and protrudes upward from the upper face of the rail portion 58.

The hook support portion 59 extends from a rear end portion of the rail portion 58 to a rear end portion of the rail formed portion 51, and includes a spring hook 65, as shown in FIGS. 4A and 4B.

The spring hook 65 is formed at a position that is almost a central portion of the hook support portion 59 in the front-rear direction, and is formed in such a manner as to be disposed in the rear of a rear edge of the rail hole 62 and away from the rear edge. The spring hook 65 also has an almost rectangular and flat plate-like shape in a side view and extends upward from an upper face of the hook support portion 59. A cutout having an almost C-shape in a side view and being open rearward is formed at a rear end of the spring hook 65 (see FIG. 9).

The rail formed portion 51 further includes a damper shaft 54 (see FIG. 3A), the slider 70 as an example of a slider, a spring 71 as an example of an elastic member, and a lock member 72 as an example of a lock member.

As shown in FIG. 3A, the damper shaft 54 has an almost column shape having an outer diameter almost equal to (slightly smaller than) an inner diameter of the damper cylinder 53. The damper shaft 54 is inserted into the damper cylinder 53. After an attachment of the tray member 41 (described later), the damper shaft 54 is pushed downward by a damper spring (not shown) interposed between a bottom face of the tray member 41 and a top face of the damper shaft 54.

Described later in detail, the slider 70 is slidably disposed in the slide guiding hole 60 of the rail portion 58, as shown in FIG. 8A. That is, the slider 70 is slidably disposed in the slide guiding hole 60 of the rail portion 58 in a slide moving direction described later.

The slider 70 has an almost prismatic column shape extending in the up-down direction (see FIG. 9). A length of the slider 70 in the left-right direction is slightly shorter than the length of the receiving hole 61 in the left-right direction, and slightly longer than the length of the rail hole 62 in the left-right direction.

Recessed grooves (not shown) constituting a pair are formed on respective central portions in the up-down direction of opposite side faces of the slider 70 in the left-right direction. Each of the recessed grooves extends from a front end of the slider 70 to a rear end of the slider 70, and is recessed inward in the left-right direction. A length of each of the recessed grooves of the slider 70 in the up-down direction is almost equal to a thickness of the rail formed portion 51.

A slider hook 75, flange portions 76, and a slider connecting portion 77 are integrally formed in the slider 70, as shown in FIG. 9.

The slider hook 75 has an almost L-shape in a side view and protrudes rearward from an upper portion of a rear face of the slider 70.

As shown in FIG. 7C, the flange portions 76 are provided at an almost central portion of the slider 70 in the up-down direction. The flange portions 76 constitute a pair which is provided one by one in a front portion and a rear portion of the slider 70 below the recessed grooves of the slider 70. Each of the flange portions 76 has an almost flat plate-like shape and protrudes from the side faces of the slider 70 in the left-right direction, along the left-right direction. Upper faces of the flange portions 76 are nearly flush with a lower face of the recessed groove. The flange portions 76 constituting the pair are formed such that a distance between opposite end portions of the flange portions 76 in the left-right direction is almost equal to a distance between the restricting protrusions 63 constituting the pair.

The slider connecting portion 77 has an almost column shape extending in the left-right direction, as shown in FIG. 9. As shown in FIGS. 7A-7C, a central portion of the slider connecting portion 77 in the left-right direction is connected to a central portion of a bottom portion of the slider 70 in the front-rear direction.

The spring 71 is an extension spring generating a spring force in a contraction direction, as shown in FIG. 8A. The spring 71 comprises a first engaging portion 85 as an example of a first engaging portion at a front end portion of the spring 71, and a second engaging portion 86 as an example of a second engaging portion at a rear end portion of the spring 71.

Each of the first engaging portion 85 and the second engaging portion 86 has an almost ring shape.

As shown in FIG. 9, the first engaging portion 85 is hooked on the slider hook 75 above the rail formed portion 51, and that the second engaging portion 86 is hooked on the spring hook 65 above the rail formed portion 51, whereby the spring 71 is provided between the slider 70 and the spring hook 65. Consequently, a force is applied to the slider 70 rearward (toward the spring hook 65). That is, in a state in which the support frame 4 is attached to main body frame 3 (the state is described later), the first engaging portion 85 is disposed in one side of the rail portion 58 while the main body connecting portion 27 is positioned in the other side of the rail portion 58 and below the rail portion 58. The second engaging portion 86 is disposed in one side of the hook support portion 59 while the main body connecting portion 27 is positioned in the other side of the hook support portion 59. The spring 71 also applies the force to the slider 70 toward the main body connecting portion 27 in the slide moving direction of the slider 70. That is, the slide moving direction of the slider 70 includes a direction in which the slider 70 comes close to the main body connecting portion 27 and a direction in which the slider 70 goes away from the main body connecting portion 27. The spring 71 is configured to apply, to a slider 70, the force in the direction in which the slider 70 comes close to the main body connecting portion 27.

As shown in FIG. 8A, the lock member 72 is provided on an upper face of the rail formed portion 51, at a side of a circumferential portion of the receiving hole 61 closer to the frame side wall 45. The lock member 72 includes a cylindrical portion 90, a leg portion 91, a restricting portion 92, and a push portion 93.

The cylindrical portion 90 has an almost hollow cylindrical shape extending in the up-down direction, and is formed such that an inner diameter of the cylindrical portion 90 is almost equal to (slightly larger than) an outer diameter of the lock shaft 64. The lock shaft 64 is rotatably inserted into the cylindrical portion 90, and thus is rotatable relative to the cylindrical portion 90.

The leg portion 91 connects to a rear edge of the cylindrical portion 90, and extends rearward. Additionally, the leg portion 91 has an almost prismatic column shape.

A pushed portion 95 is integrally formed in the leg portion 91.

The pushed portion 95 is provided on an upper face of the leg portion 91 at a rear end portion of the leg portion 91, and has an almost rectangular shape in a plan view. The pushed portion 95 also protrudes upward from the upper face of the leg portion 91. The rear end portion of the leg portion 91 is provided with an insertion portion (not shown) protruding downward from a lower face of the rear end of the leg portion 91.

The restricting portion 92 has an almost rectangular shape in a plan view and protrudes rightward from the rear end portion of the leg portion 91. A rear end face of the restricting portion 92 is formed as a first face 96 as an example of a first face, and a right side face of the restricting portion 92 is formed as a second face 97 as an example of a second face.

The first face 96 is formed to incline such that, as an imaginary point on the first face 96 moves from a left edge to a right edge, the imaginary point moves forward.

The second face 97 is formed to extend forward from a right edge portion of the first face 96.

The push portion 93 comprises a base 98 and a push spring 99.

The base 98 has an almost rectangular shape in a plan view, and is fixedly disposed on the rail formed portion 51, at a left side of the pushed portion 95 and away from the pushed portion 95.

The push spring 99 is disposed between the base 98 and the pushed portion 95. A right end portion of the push spring 99 is connected to a left side face of the pushed portion 95, and a left end portion of the push spring 99 is connected to a right side face of the base 98. Consequently, the push spring 99 pushes the restricting portion 92 rightward by way of the pushed portion 95.

That is, the lock shaft 64 is inserted into the cylindrical portion 90, whereby the lock member 72 is rotatably disposed on the upper face of the rail formed portion 51, and is pushed rightward by the push portion 93. It is noted that the lock member 72 and the restricting protrusions 63 are overlapped with each other in a direction which is perpendicular to both of the slide moving direction of the slider 70 and a direction in which the main body frame 3 and the support frame 4 face to each other when the support frame 4 is in the close position.

(2) Tray Member

The tray member 41 is disposed on an upper face of the pivotal frame 40, as shown in FIGS. 2 and 3A. The tray member 41 extends in the front-rear direction and has an almost U-shape being open upward in a front view. Additionally, an upper face of the tray member 41 is a face of the aforementioned sheet discharged tray 18.

A lower portion of the tray member 41 is open downward, and has such a dimension in the front-rear direction and the left-right direction that accommodates the pivotal frame 40.

The tray member 41 has fitting protrusion portions 103 and a grip portion 104, as shown in FIG. 3A.

The fitting protrusion portions 103 are constituted as a pair, and are provided at respective lower edge portions of front edge portions of the tray member 41 with a space provided between the fitting protrusion portions 103 in the left-right direction. Described later in detail, the fitting protrusion portions 103 are fitted in the respective fitting recessed portions 30, whereby the support frame 4 is kept in the close position relative to the main body frame 3.

The grip portion 104 is provided such that the user is able to grip the grip portion 104 in order to pivot the support frame 4. The grip portion 104 is provided in a central portion of a front edge portion of the tray member 41 in the left-right direction. The grip portion 104 also has an almost U-shape and is recessed upward from a lower face of the tray member 41 and opens downward in a front view. The grip portion 104 is provided with a hook release portion 107.

The hook release portion 107 is partly exposed in a front view. Not shown in the figures, both ends of the hook release portion 107 in the left-right direction are connected to the respective fitting protrusion portions 103 constituting the pair.

(3) Side Cover

Each of the side covers 42 extends in the front-rear direction, and has an almost U-shape in a cross sectional view being open inward in the left-right direction. Each of the side covers 42 is formed such that lengths thereof in the front-rear direction and the up-down direction are almost equal to respective lengths of the tray member 41. The side covers 42 are provided so as to cover the tray member 41 from outsides thereof in the left-right direction.

4. Image Recording Unit

As shown in FIG. 2, the support frame 4 includes the image reading unit 10 at an upper side of the support frame 4, that is, on a side of the support frame 4 opposite to a side of the support frame 4 in which the main body frame 3 is disposed.

The image reading unit 10 is pivoted together with the support frame 4 relative to the main body frame 3.

In the image reading unit 10, an image recorded sheet is placed between a hold cover 11 and a glass surface (not shown), and then image information on the image recorded sheet is scanned.

5. Arm

As shown in FIG. 3A, arms 110 which are constituting an example of an arm member are provided between the main body frame 3 and the support frame 4 of the main body casing 2.

It is noted that the following description is explained in the state in which the support frame 4 is in the close position (see FIG. 4A).

Each of the arms 110 includes an arm body portion 111, a pair of first connecting portions 112, and a pair of second connecting portions 113, as shown in FIG. 4A.

The arm body portion 111 has an almost beam-like shape extending in the front-rear direction.

Each of the first connecting portions 112 constituting the pair has an almost flat plate-like shape. And each of the connecting portions 112 protrudes rearward from a corresponding one of left and right end portions of rear end portions of the arm body portion 111 and slightly protrudes downward. That is, the first connecting portions 112 constituting the pair are disposed in such a manner as to face to each other in the left-right direction with a space provided between the first connecting portions 112. The first connecting portions 112 include respective connecting protrusions 115.

Each of the connecting protrusion 115 has an almost column shape and extends outward in the left-right direction from an outer face of a corresponding one of the first connecting portions 112 constituting the pair. The connecting protrusions 115 provided on the respective first connecting portions 112 constituting the pair are also disposed in such a manner as to have the same central axis line which is a common central axis of the connecting protrusions 115.

Each of the second connecting portions 113 constituting the pair has an almost flat plate-like shape and protrudes upward from a corresponding one of left and right end portions of a front end portion of the arm body portion 111. That is, the second connecting portions 113 constituting the pair are disposed in such a manner as to face to each other in the left-right direction with a space provided between the second connecting portions 113. A distance of the second connecting portions 113 constituting the pair is slightly smaller than a length of the slider connecting portion 77 in the left-right direction. The second connecting portions 113 include respective connection holes 117.

Each of the connection holes 117 has an almost circular shape in a side view and is formed through a corresponding one of the second connecting portions 113. The connection holes 117 provided on the respective second connecting portions 113 constituting the pair are also disposed in such a manner as to have the same central axis line which is a common central axis of the connection holes 117.

Figure 3B:
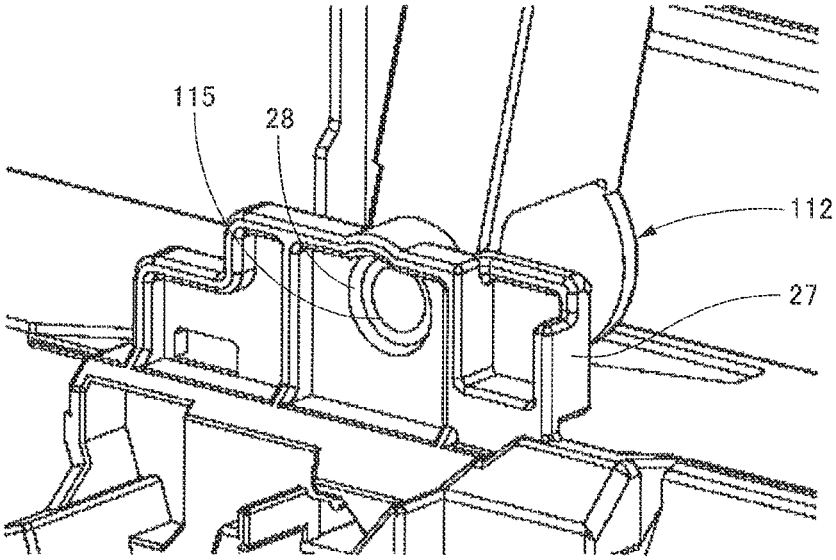

Then, one of the connecting protrusions 115 is rotatably fitted in the through hole 28 of the main body connecting portion 27 of the main body casing 2 while the other of the connecting protrusions 115 is rotatably fitted in a connection groove (not shown) of the main body casing 2, whereby each of the arms 110 is pivotably connected to the main body casing 2 (see FIGS. 3A and 3B).

Additionally, the two connection holes 117 are rotatably fitted on left and right end portions of the slider connecting portions 77 of the sliders 70 of the support frame 4, whereby each of the arms 110 is pivotably connected to the support frame 4.

6. Assembly of Printer

The following is a description regarding a method of assembling the printer 1.

Firstly, each component is attached or fitted to the pivotal frame 40 in order to assemble the printer 1.

(1) Attachments of Components to Pivoting Frame

In order to attach components to the pivotal frame 40, the pivotal frame 40 and the sliders 70 are prepared, and then each of the sliders 70 is attached to the rail formed portion 51 of the pivotal frame 40.

In order to attach the slider 70 to the rail formed portion 51, the slider 70 is inserted through the receiving hole 61 of the slide guiding hole 60 in as a way as to move the slider 70 from under the receiving hole 61 to above the receiving hole 61, as shown in FIG. 7C.

Thus, the upper faces of the flange portions 76 of the slider 70 come in contact with the bottom face of the rail portion 58.

Then, the slider 70 is slidingly moved rearward along the rail hole 62 of the slider 70 in a state in which the upper faces of the flange portions 76 of the slider 70 are in contact with the bottom face of the rail portion 58. Thus, the recessed grooves of the slider 70 are slidably fitted on the rail portion 58 which are circumferential edges of the rail hole 62.

Consequently, the slider 70 is attached to the rail formed portion 51 of the pivotal frame 40.

Next, each of the springs 71 is attached to the slider 70 and the pivotal frame 40, as shown in FIG. 8A.

In order to attach the springs 71 to the respective sliders 70 and the pivotal frame 40, the first engaging portion 85 of the spring 71 is hooked on the slider hook 75 of the slider 70 from above the slider hook 75, whereby the first engaging portion 85 is engaged with the slider hook 75.

Then, the spring 71 is pulled backward to be expanded, and the second engaging portion 86 is hooked on the spring hook 65, whereby the second engaging portion 86 is engaged with the spring hook 65.

Consequently, the attachments of the springs 71 to the slider 70 and the pivotal frame 40 are completed.

A force of the spring 71 is thus applied to the slider 70 rearward (toward the spring hook 65).

Next, the lock members 72 are attached to the pivotal frame 40.

In order to attach each of the lock members 72 to the pivotal frame 40, the cylindrical portion 90 of the lock member 72 is rotatably fitted on the lock shaft 64 of the rail formed portion 51, while an insertion portion (not shown) of the leg portion 91 of the lock member 72 is movably inserted into the lock guide hole 66 of the rail formed portion 51.

Additionally, the push spring 99 is connected to the right side face of the base 98 of the push portion 93 and the left side face of the pushed portion 95 of the restricting portion 92.

Consequently, the lock member 72 is attached in such a manner as to be pivotable around the lock shaft 64, and the push spring 99 elastically pushes the restricting portion 92 rightward by way of the pushed portion 95.

As described above, the attachments of the components to the pivotal frame 40 are completed.

(2) Attachment of Arm to Main Body Frame

Figure 6A:
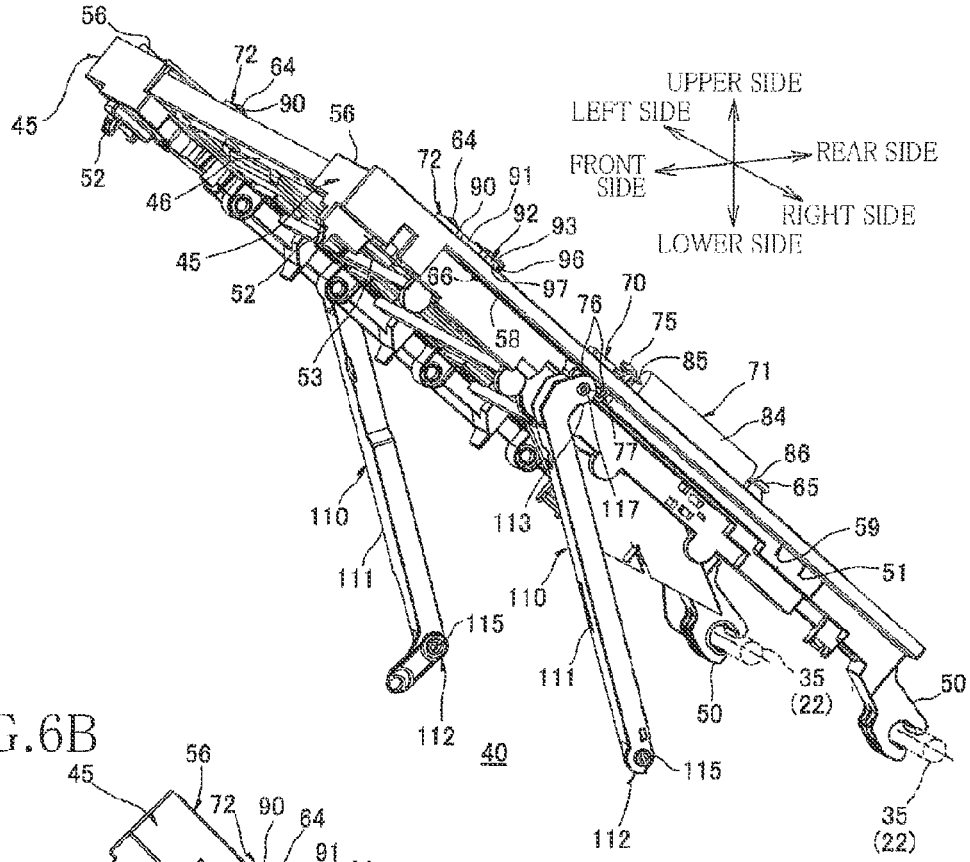

Next, the pivotal frame 40 is attached to the main body frame 3, as shown in FIG. 6A.

In order to attach the pivotal frame 40 to the main body frame 3, the first connecting portions 112 of the arms 110 are connected to the respective main body connecting portions 27 of the main body frame 3.

Specifically, each of the first connecting portions 112 of the arms 110 is disposed near the corresponding main body connecting portion 27 such that the arm 110 inclines in such a manner as to put the first connecting portion 112 of the arm 110 to a lower and more rearward position than the other portion of the first connecting portion 112. Then, each of the connecting protrusions 115 of the first connecting portions 112 is inserted into the corresponding one of the through hole 28 of the main body connecting portion 27 and the connection groove (not shown) of the side walls 22.

Consequently, the arm 110 is pivotably supported by the main body frame 3.

(3) Assembly of Support Frame

Next, the support frame 4 is assembled as shown in FIG. 3A.

In order to assemble the support frame 4, the tray member 41 is attached to the pivotal frame 40 from above.

Then, the side covers 42 are attached to respective opposite side faces of the pivotal frame 40 and respective opposite side faces of the tray member 41 in the left-right direction in such a manner as to cover the pivotal frame 40 and the tray member 41.

Consequently, the springs 71 attached on the upper face of the pivotal frame 40 are covered by the tray member 41 and the side covers 42 so as to be accommodated in the support frame 4.

Next, the image reading unit 10 is attached at the upper side of the support frame 4, that is, on the side of the support frame 4 opposite to the side in which the main body frame 3 is disposed.

(4) Attachment of Support Frame to Main Body Frame

Next, the support frame 4 is attached to the main body frame 3. The support frame 4 is inclined such that the rear edge portion of the support frame 4 is positioned lower than others. Then, the pivotal portion 50 of the pivotal frame 40 is rotatably engaged with the pivotal shaft 35 of the main body frame 3.

Figure 10:
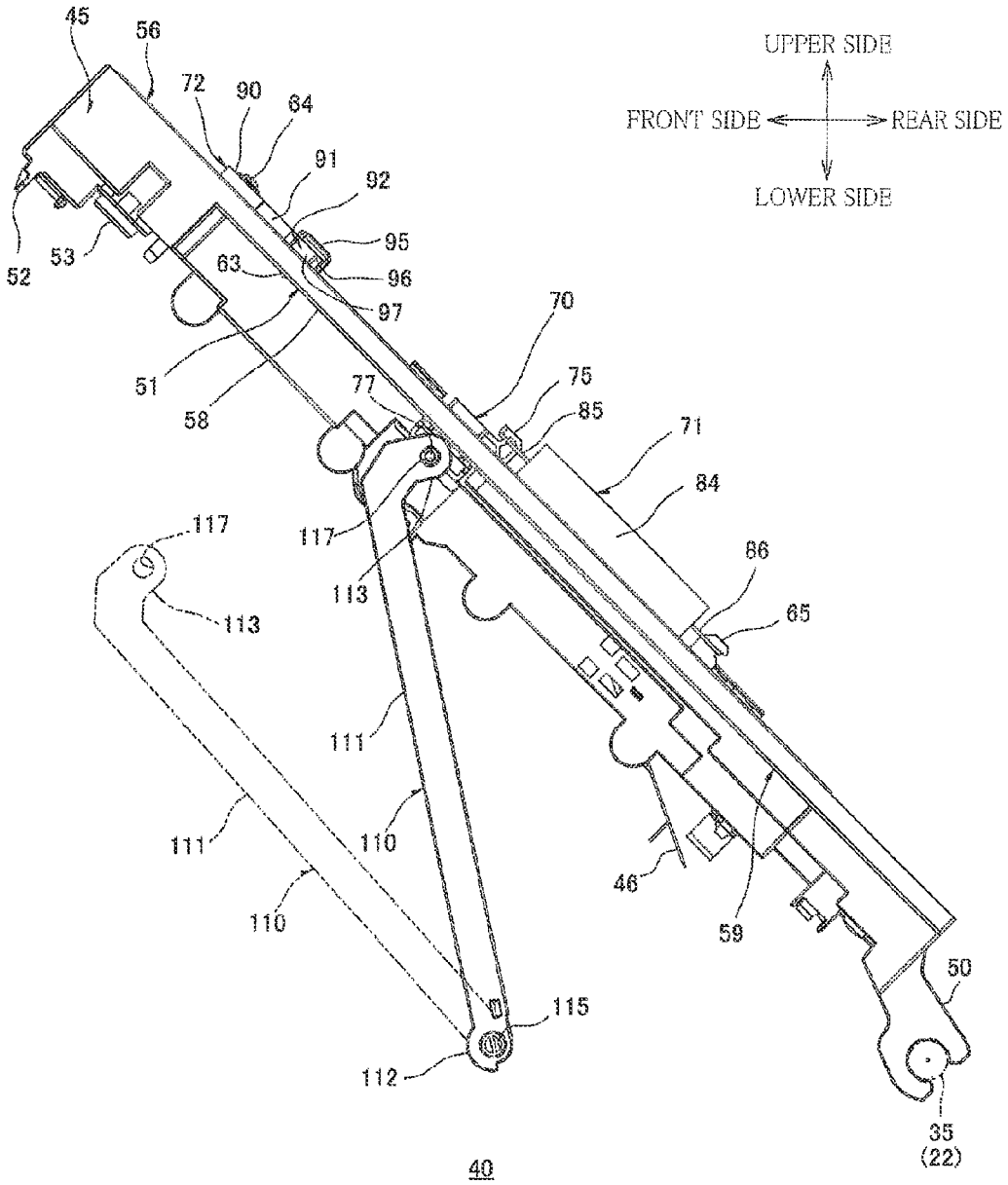
FIG. 10 is a view for illustrating an attachment of an arm shown in FIG. 3A.

As shown in FIG. 10, while the pivotal frame 40 is kept in the open position, each of the arms 110 is pivoted clockwise around the connecting protrusions 115 in a right side view so as to bring the second connecting portions 113 of the arm 110 constituting the pair to come into contact with the slider connecting portion 77.

Thus, each of the second connecting portions 113 constituting the pair is elastically deformed outward in the left-right direction.

The arm 110 is further pivoted clockwise in a right side view, and then the connection holes 117 face to the respective slider connecting portions 77 in the left-right direction. Consequently, the deformations of the second connecting portions 113 constituting the pair are cancelled and the second connecting portions 113 are brought into their respective original states. Therefore, the left and right end portions of the slider connecting portion 77 of the slider 70 are inserted into the respective connection holes 117 of the second connecting portions 113.

Consequently, the arm 110 is pivotably connected to the slider connecting portion 77 of the slider 70.

The support frame 4 is configured to be pivotable together with the pivotal frame 40 relative to the main body frame 3. Additionally, the image reading unit 10 is configured to be pivotable together with the support frame 4 relative to the main body frame 3.

As described above, the attachment of the support frame 4 to the main body frame 3 is completed, and thus the assembly of the printer 1 is completed.

7. Open and Close Motions of Support Frame

As shown in FIGS. 4A and 4B, when the support frame 4 is in the close position, each of the arms 110 is put in a fallen state in which the arm 110 is pivoted around the connecting protrusions 15 of the first connecting portions 112 to be fallen such that the arm 110 extends in the front-rear direction. Therefore, each of the sliders 70 is located in a front side of the corresponding rail hole 62.

The position-determining protrusion portions 52 of the support frame 4 are inserted into the respective position-determining recessed portions 29, and the fitting protrusion portions 103 of the support frame 4 are fitted in the respective fitting recess portions 30 (see each of the portions in FIG. 3A). Consequently, the support frame 4 is kept in the close position (see FIG. 2).

In order to move the support frame 4 from the close position to the open position, the grip portion 104 of the support frame 4 is gripped and the hook release portion 107 is pushed. When the hook release portion 107 is operated, the interlocked fitting protrusion portions 103 are operated together so that the fittings of the fitting protrusion portions 103 in the respective fitting recess portions 30 are released.

Then, the support frame 4 is moved upward while the grip portion 104 is gripped.

At that time, the fitting protrusion portions 103 are separated away from the respective fitting recess portions 30, and the position-determining protrusion portions 52 are separated away from the respective position-determining recessed portions 29.

In addition, the sliders 70 are pushed rearward by the respective springs 71. This assists the pivoting of the support frame 4 from the close position to the open position.

When the support frame 4 is moved toward the open position, each of the sliders 70 is slidingly moved by the pull force of the spring 71 to a rear end portion of the rail hole 62 along the rail hole 62.

Hereinafter, a locus on which the slider 70 slidingly moves along the rail hole 62 in the front-rear direction is referred to as a movement locus.

Consequently, the second connecting portions 113 move together with the slider 70, and thus the force is applied to each of the arms 110 such that the arm 110 uprises from the fallen state to an uprise state in which the arm 110 uprises in the up-down direction. Accordingly, the arm 110 is pivoted clockwise around the first connecting portion 112 in a right side view.

Consequently, the support frame 4 is kept in the open position (see FIG. 3A).

As shown in FIG. 8A, the restricting portion 92 of the lock member 72 is pushed rightward by the push spring 99. Therefore, the lock member 72 is positioned in a lock position in which a right edge portion of the restricting portion 92 (the first face 96 and the second face 97) is positioned in the movement locus of the slider 70.

On the other hand, in order to move the support frame 4 from the open position to the close position, a front edge portion of the support frame 4 is moved downward.

At that time, each of the sliders 70 is moved forward against the pull force of the spring 71, along the rail hole 62, as shown in FIG. 8B.

Figure 5A:
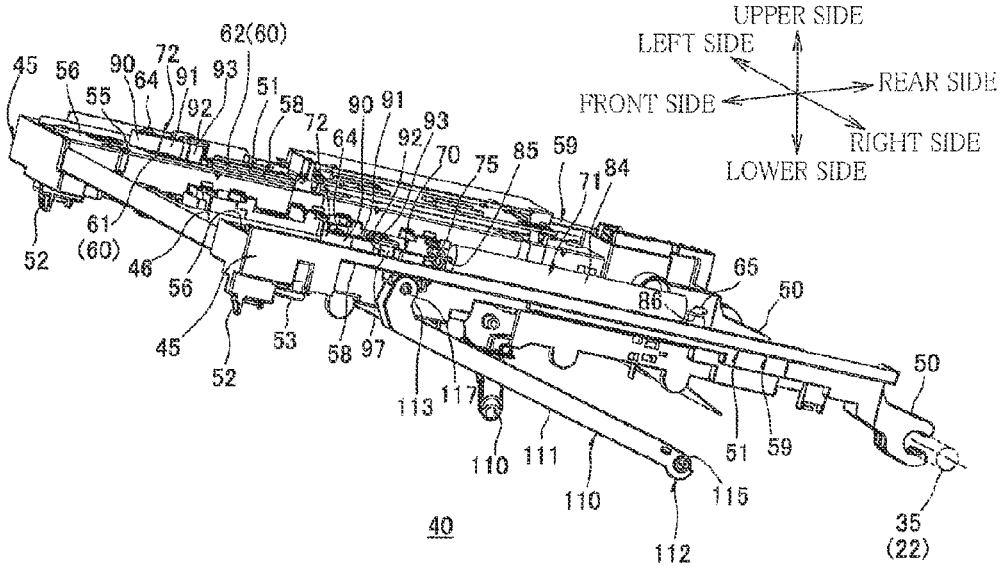
Figure 5B:
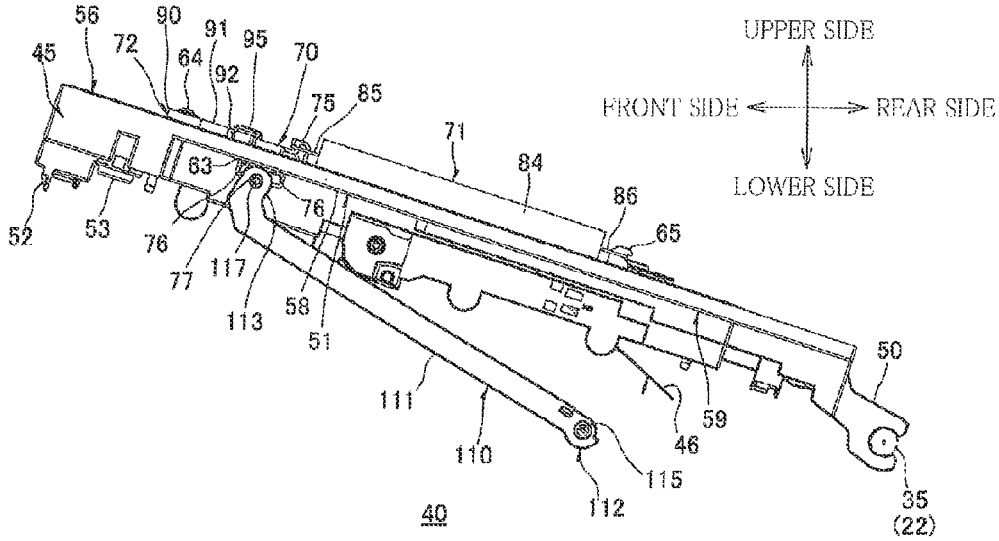

Consequently, as shown in FIG. 5, each of the second connecting portions 113 moves together with die slider 70, and thus each of the arms 110 is pivoted counter-clockwise around the first connecting portion 112 in a right side view. Therefore, the support frame 4 is pivoted counter-clockwise around the pivotal shaft 35 of the main body frame 3.

Then, the support frame 4 is positioned at an intermediate position in which the support frame 4 is positioned in an area between the open position and the close position.

When the support frame 4 is moved to the intermediate position, the flange portions 76 of the slider 70 come into contact with respective rear sides of the restricting protrusions 63 of the rail portion 58 (see FIG. 7B), and the slider 70 comes into contact with the first face 96 formed in the restricting portion 92 of the lock member 72 positioned in the lock position (see FIG. 8B).

Then, when the support frame 4 is further moved downward from the intermediate position, each of the flange portions 76 of the slider 70 is elastically deformed downward by a protrusion height of the restricting protrusion 63, as shown in FIG. 7B. When the support frame 4 is further pushed downward, the flange portions 76 go over the respective restricting protrusions 63 and slidingly move forward, as shown in FIG. 7C. Consequently, the elastic deformations of the flange portions 76 are cancelled, and the upper faces of the flange portions 76 come in contact with the bottom face of the rail portion 58.

In addition, when the support frame 4 is further moved downward, the slider 70 is slidingly moved forward along the rail hole 62 while the slider 70 slides on the first face 96 and pushes the restricting portion 92 leftward against the push force of the push spring 99.

Then, as shown in FIG. 8C, the second face 97 of the restricting portion 92 of the lock member 72 comes into contact with the slider 70. That is, the lock member 72 is positioned in an unlock position in which the right edge portion of the restricting portion 92 (the first face 96 and the second face 97) is positioned out of the movement locus.

Thus, the contact of the slider 70 with the restricting protrusions 63 and the contact of the slider 70 with the lock member 72 restricts the forward slide movement of the slider 70. Consequently, unnecessary fast pivoting of the support frame 4 from the open position to the close position will be restricted.

Additionally, as shown in FIG. 3A, when the support frame 4 is further moved downward, each of the damper shafts 54 comes in contact with an upper face of the main body frame 3 so as to be moved upward into the damper cylinder 53 against a force of the damper spring (not shown).

Then, as shown in FIGS. 4A and 4B, each of the arms 110 is positioned in the fallen state.

At that time, the position-determining protrusion portions 52 of the support frame 4 are inserted into the respective position-determining recessed portions 29, and the fitting protrusion portions 103 of the support frame 4 are fitted in the respective fitting recess portions 30 (see each of the portions in FIG. 3A). Consequently, the support frame 4 is kept in the close position (see FIG. 2).

Consequently, as shown in FIG. 2, the grip portion 104 faces to the receiving recess portion 32.

In order to move the support frame 4 from the close position to the open position again, the support frame 4 is moved upward while the grip portion 104 is gripped.

At that time, since the damper shaft 54 is pushed downward by the damper spring (not shown), the pivoting of the support frame 4 is assisted, and the support frame 4 moves from the close position to the intermediate position.

At the same time, as shown in FIG. 8C, the slider 70 is slidingly moved rearward along the rail hole 62 while a left face of the slider 70 slides on the second face 97 of the lock member 72.

When the slider 70 is slidingly moved rearward along the rail hole 62 as described above, the lock member 72 is in contact with the left face of the slider 70. Therefore, a resistance of the lock member 72 against the slide movement of the slider 70 is smaller than that of when the slider 70 is slidingly moved forward along the rail hole 62.

At the intermediate position, the flange portions 76 of the slider 70 are in contact with the respective front portions of the restricting protrusions 63 of the rail portion 58, as shown in FIG. 7C. Therefore, the flange portions 76 are elastically deformed downward by the protrusion height of the restricting protrusion 63. When the support frame 4 is further pushed upward, the flange portion 70 goes over the restricting protrusion 63 and slidingly moves rearward, as shown in FIG. 7B. Consequently, the elastic deformations of the flange portion 76 are canceled, and the upper faces of the flange portions 76 come in contact with the bottom face of the rail portion 58.

When the slider 70 is slidingly moved rearward along the rail hole 62 as described above, the slider 70 comes into contact with the front portion of the restricting protrusion 63 whose bottom face has the small angle relative to the bottom face of the rail portion 58. That is, the small angle is smaller than an angle of the rear portion of the restricting protrusion 63 relative to the bottom face of the rail portion 58. Therefore, a resistance of the restricting protrusion 63 against the slide movement of the slider 70 is smaller than that of when the slider 70 is slidingly moved forward along the rail hole 62.

When the support frame 4 is further moved upward, the support frame 4 is kept in the open position (see FIG. 3A).

Figure 6B:
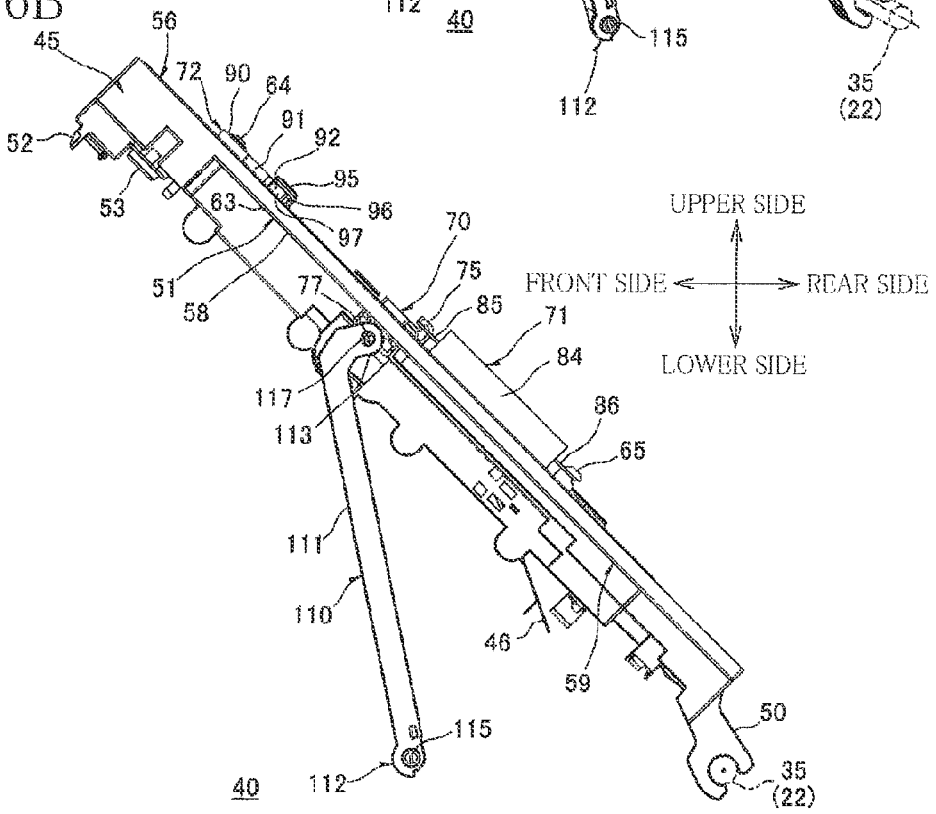

8. Effect (1) According to the printer 1, as shown in FIGS. 6A and 6B the support frame 4 is provided with the slider 70. In addition, the first engaging portion 85 of the spring 71 is engaged with the slider 70, and the second engaging portion 86 of the spring 71 is engaged with the spring hook 65 of the support frame 4.

Therefore, in an assembly process of the printer 1 described above, firstly, Each of the springs 71 is attached to the support frame 4 and the slider 70. Then, after the attachment of the springs 71, the arms 110 is attached to the slider 70 and the main body frame 3.

That is, since the spring 71 is attached to the support frame 4 and the slider 70 having been provided in the support frame 4 in the assembly process of the printer 1, attachment works for the springs 71 and the arms 110 are facilitated compared to attachment works for firstly attaching arms to a main body frame and a support frame, and then attaching springs to the respective anus.

Therefore, the assembly work of the printer 1 is facilitated.

In addition, since the spring 71 pulls the slider 70 toward the main body connecting portion 27 in the slide moving direction of the sliders 70, the support frame 4 is pulled by the spring 71 by way of the slider 70 and the arm 110 so as to be positioned to the open position.

That is, while the support frame 4 is pulled by the spring 71 so as to be positioned to the open position, the assembly work of the printer 1 is facilitated.

(2) According to the printer 1, as shown in FIGS. 7 and 8, the support frame 4 is provided with the rail portions 58.

Therefore, each of the rail portions 58 guides the slide movement of the corresponding slider 70, thereby ensuring a sure slide movement of the slider 70.

(3) According to the printer 1, as shown in FIGS. 7A-7C, since the restricting protrusions 63 are provided within the locus of the slide movement of the slider 70, the slider 70 comes into contact with the corresponding restricting protrusions 63 when the slider 70 is slidingly moved away from the main body connecting portion 27.

That is, when the support frame 4 is pivoted from the open position to the close position, the slide movement of the slider 70 is surely restricted by the restricting protrusions 63.

Therefore, unnecessary fast pivoting of the support frame 4 from the open position to the close position is restricted.

(4) According to the printer 1, as shown in FIGS. 8A-8C, when the support frame 4 is positioned in the open position, the lock member 72 is positioned in the lock position.

Therefore, when the slider 70 is slidingly moved away from the main body connecting portion 27, the slider 70 comes into contact with the restricting portion 92 of the lock member 72 positioned in the locus.

That is, when the support frame 4 is pivoted from the open position to the close position, the slide movement of the slider 70 is surely restricted by the lock member 72.

Therefore, unnecessary fast pivoting of the support frame 4 from the open position to the close position is restricted.

(5) According to the printer 1, as shown in FIGS. 8A-8C, when the slider 70 is slidingly moved away from the main body connecting portion 27 in a state in which the lock member 72 is positioned in the lock position, the slider 70 comes into contact with the first face 96 of the lock member 72 in the locus.

On the other hand, when the slider 70 is slidingly moved toward the main body connecting portion 27 in the slide moving direction of the slider 70 in a state in which the lock member 72 is positioned in the unlock position, the slider 70 comes into contact with the second face 97 of the lock member 72 out of the locus.

Therefore, when the slider 70 is slidingly moved toward the main body connecting portion 27, the resistance of the lock member 72 against the slide movement of the slider 70 is set to be smaller than that of when the slider 70 is slidingly moved away from the main body connecting portion 27.

As a result, when the slider 70 is slidingly moved toward the main body connecting portion 27, that is, when the support frame 4 is pivoted from the close position to the open position, the support frame 4 is smoothly pivoted.

Accordingly, while unnecessary fast pivoting of the support frame 4 from the open position to the close position is restricted, the support frame 4 is smoothly pivoted from the close position to the open position.

(6) According to the printer 1, as shown in FIG. 3A, the main body opening portion 5 is uncovered by pivoting the support frame 4 to the open position, and is covered by pivoting the support frame 4 to the close position.

Therefore, the process cartridges 6 is easy, through the main body opening portion 5, to be attached to the main body frame 3 and to be detached from the main body frame 3.

(7) According to the printer 1, as shown in FIG. 3A, since the LED unit 12 is attached to the support frame 4, a weight of the support frame 4 increases, compared to that of a support frame of a printer in which an LED unit is attached to a main body frame.

As the weight of the support frame 4 increases, the pull force of the spring 71 is set to be larger in order to stay the support frame 4 in the open position.

Therefore, the attachment works of the springs 71 need more labor.

However, in the structure in which the support frame 4 includes the sliders 70, since the springs 71 are attached to the support frame 4 and the respective sliders 70 in the assembly process of the printer 1, the attachment works of the springs 71 are smoothed despite the larger pull forces of the springs 71.

In addition, the pivoting of the support frame 4 from the close position to the open position is assisted by the pull forces of the springs 71. Therefore, though the weight of the support frame 4 increase, the support frame 4 is stably pivoted from the close position to the open position, compared to the printer in which the LED unit is attached to the main body frame.

(8) According to the printer 1, as shown in FIG. 3A, since the image reading unit 10 is attached to the support frame 4, the weight of the support frame 4 increases, compared to that of a support frame of a printer in which an reading unit is attached to a main body frame.

As the weight of the support frame 4 increases, the pull force of the spring 71 is set to be larger in order to stay the support frame 4 in the open position.

Therefore, the attachment works of the springs 71 need more labor.

However, in the structure in which the support frame 4 includes the sliders 70, since the springs 71 are attached to the support frame 4 and the respective sliders 70 in the assembly process of the printer 1, the attachment works of the springs 71 are smoothed despite the larger pull forces of the springs 71, compared to attachment works in a printer in which a main body frame includes sliders.

In addition, the pivoting of the support frame 4 from the close position to the open position is assisted by the pull forces of the springs 71. Therefore, though the weight of the support frame 4 increases, the support frame 4 is stably pivoted from the close position to the open position, compared to a printer in which no spring is provided.

(9) According to the printer 1, as shown in FIG. 3A, each of the slide movements of the sliders 70 toward the pivot point in the slide moving direction of the slider 70 is assisted by the pull force of the corresponding spring 71.

Therefore, the springs 71 surely pull the support frame 4 from the close position to the open position, by way of the sliders 70 and the arms 110.

On the other hand, when the support frame 4 is pivoted from the open position to the close position, each of the sliders 70 is slidingly moved away from the pivot point against the pull force of the corresponding spring 71. Therefore, the sliders 70 and the arms 110 serve as a damper mechanism, and thus the pivoting of the support frame 4 is restricted in a speed.

As a result, unnecessary fast pivoting of the support frame 4 from the open position to the close position is surely restricted, thereby improving a handleability of the support frame 4.

(10) According to the printer 1, as shown in FIGS. 4A and 4B, the sliders 70 are slidably provided in the support frame 4 to be pivoted, and each of the springs 71 is engaged with the corresponding slider 70 and the support frame 4.

Therefore, when a user applies a force to the support frame 4 in order to pivot the support frame 4, the force is more smoothly transmitted to the sliders 70 than a force in a case in which a slider is attached to a main body frame.

As a result, the support frame 4 is surely pivoted more smoothly.

In addition, since the sliders 70 are attached to the support frame 4, a larger space is made in the main body frame 3 compared to a space in a case in which a slider is provided in a main body frame.

(11) According to the printer 1, as shown in FIGS. 4A and 4B, the first engaging portion 85 of the spring 71 is disposed in the one side of the rail portion 58 and engages with the slider 70 while the main body connecting portion 27 is positioned in the other side of the rail portion 58, and the second engaging portion 86 is disposed in the one side of the hook support portion 59 and engages with the support frame 4 while the main body connecting portion 27 is disposed in the other side of the hook support portion 59. Therefore, each of the springs 71 is disposed in the one side of the rail portion 58 and the hook support portion 59 in which the main body connecting portion 27 does not exist.

That is, the rail portion 58 and the hook support portion 59 exist between the spring 71 and the main body frame 3.

Therefore, the springs 71 are prevented from being exposed to the main body frame 3.

9. Modified Embodiment

Though the slider 70 is provided in the support frame 4 in the above described embodiment, the slider 70 is provided in the main body frame 3 in a first modified embodiment.

In the first modified embodiment, the main body frame 3 is an example as one of a first housing and a second housing while the support frame 4 is an example as the other of a first housing and a second housing. In the first modified embodiment, a slider is attached to the main body frame 3, and a spring is attached to the slider and the main body frame 3. Afterward, a connecting portion of the arm is connected to the main body frame 3, and then the support frame 4 is pivotably attached to the main body frame 3 to which the arm has been attached. The first modified embodiment provides the same effect as the above described embodiment.

Moreover, though the above described embodiment employs, for each of the springs 71, the extension spring generating the spring force in the contraction direction, a second modified embodiment employs, for each of the springs 71, a compression spring generating a spring force in an expansion direction.

That is, the second modified embodiment utilizes a spring force generated by an expansion of the spring 71, and the spring force pushes the slider 70 toward the main body connecting portion 27 along the rail hole 62. Therefore, the arm 110 is forced from the fallen state to the uprise state, and thus a pivoting of the support frame 4 from the close position to the open position is assisted.

The second modified embodiment provides the same effect as the above described embodiment.

It is noted that the above described embodiment, the first modified embodiment, and the second modified embodiment may be combined appropriately.

Specifically, in the above described embodiment, the slider 70 and the spring book 65 are provided in the support frame 4, and the main body connecting portion 27 is provided in the main body frame 3. The main body connecting portion 27 and the spring hook 65 are positioned behind the slider 70 in a state in which the support frame 4 is in the close position. The spring 71, which is the extension spring, is engaged with the slider 70 and the spring hook 65. The slider 70 is pulled rearward (toward the main body connecting portion 27) by the force of the extension spring in the contraction direction.

In contrast to the above described embodiment, there may be a modified embodiment in which the spring hook 65 is disposed in front of the slider 70, and the spring 71, which is the compression spring, pushes the slider 70 rearward (toward the main body connecting portion 27) by the force of the compression spring in the expansion direction.

Moreover, in contrast to the above described embodiment, there may be a modified embodiment in which the main body connecting portion 27 is disposed in front of the slider 70, and the spring 71, which is the compression spring, pushes the slider 70 forward (toward the main body connecting portion 27) by the force of the compression spring in the expansion direction.

Moreover, in contrast to the above described embodiment, there may be a modified embodiment in which the main body connecting portion 27 and the spring hook 65 are disposed in front of the slider 70, and the spring 71, which is the extension spring, pulls the slider 70 forward (toward the main body connecting portion 27) by the force of the extension spring in the contraction direction.

Moreover, in contrast to the above described embodiment, there may be a modified embodiment in which the slider 70 and the spring hook 65 are provided in the main body frame 3, and the main body connecting portion 27 is provided in the support frame 4.

There is a modified embodiment in which the slider 70 and the spring hook 65 are provided in the main body frame 3, and the main body connecting portion 27 is provided in the support frame 4. Then, in the modified embodiment, the spring hook 65 is disposed in front of the slider 70, and the spring 71, which is the compression spring, pushes the slider 70 rearward (toward the main body connecting portion 27) by the force of the compression spring in the expansion direction.

There is a modified embodiment in which the slider 70 and the spring hook 65 are provided in the main body frame 3, and the main body connecting portion 27 is provided in the support frame 4. Then, in the modified embodiment, the main body connecting portion 27 is disposed in front of the slider 70, and the spring 71, which is the compression spring, pushes the slider 70 forward (toward the main body connecting portion 27) by the force of the compression spring in the expansion direction.

There is a modified embodiment in which the slider 70 and the spring hook 65 are provided in the main body frame 3, and the main body connecting portion 27 is provided in the support frame 4. Then, in the modified embodiment, the main body connecting portion 27 and the spring hook 65 are disposed in front of the slider 70, and the spring 71, which is the extension spring, pushes the slider 70 forward (toward the main body connecting portion 27) by the force of the extension spring in the contraction direction.

What is claimed is:

1. An image forming apparatus comprising:

a first housing;

a second housing configured to be pivotable, relative to the first housing, between an open position and a closed position;

a slider provided in one of the first housing and the second housing, the slider configured to be slidable relative to the one of the first housing and the second housing in a slide moving direction, the slider comprising a slider connecting portion that is a portion of the slider;

a housing connecting portion provided in the other of the first housing and the second housing;

an arm member, configured to be connected to each of the slider and the housing connecting portion and to be pivotable relative to each of the slider and the housing connecting portion, the arm member comprising an arm connecting portion that is a portion of the arm member and that is pivotally connected to the slider connecting portion; and an elastic member comprising a first engaging portion engaging with the slider and a second engaging portion engaging with the one of the first housing and the second housing, wherein the elastic member is configured to apply, to the slider, a force in a direction in which the slider moves closer to the housing connecting portion along the slide moving direction, when the second housing is in the closed position.

2. The image forming apparatus according to claim 1, wherein the one of the first housing and the second housing further comprises a rail portion configured to guide a slide movement of the slider.

3. The image forming apparatus according to claim 1, wherein the one of the first housing and the second housing comprises a restricting mechanism configured to restrict a slide movement of the slider when the slider moves away from the housing connecting portion along the slide moving direction.

4. The image forming apparatus according to claim 3, wherein the restricting mechanism comprises a protruding portion disposed within a locus of the slide movement of the slider.

5. The image forming apparatus according to claim 4, wherein the protruding portion comprises:

a first inclined face inclined relative to the slide moving direction of the slider, the first inclined, face being configured to restrict a movement of the slider that occurs when the second housing pivots to the open position; and a second inclined face formed at a downstream side of the first inclined face in a moving direction in Which the slider moves when the second housing pivots to the open position, the second inclined face inclined relative to the slide moving direction of the slider, wherein the second inclined face is configured to restrict a movement of the slider that occurs when the second housing pivots to the closed position, and wherein the second inclined face has a greater incline than the first inclined face with respect to the slide moving direction.

6. The image forming apparatus according to claim 3, wherein the restricting mechanism comprises a lock member contactable with the slider, wherein the lock member is movable between a lock position in which at least a portion of the lock member is positioned in the locus of the slide movement of the slider and an unlock position in which the at least the portion of the lock member is positioned outside of the locus, and wherein, when the second housing is in the open position, the lock member is in the lock position.

7. The image forming apparatus according to claim 6, wherein the lock member comprises:

a first face configured to come into contact with the slider, while positioned in the locus of the slide movement of the slider when the lock member is in the lock position; and a second face configured to be in contact with the slider, while positioned outside of the locus when the lock member is in the unlock position.

8. The image forming apparatus according to claim 7, wherein the first face is a face inclined relative to the slide moving direction of the slider in a state in which the lock member is located in the unlock position.

9. The image forming apparatus according to claim 6, wherein the one of the first housing and the second housing further comprises a rail portion configured to guide a slide movement of the slider, wherein the lock member is rotatably supported by a shaft provided in the rail portion, and wherein the lock member is applied by a force application member with a force in a direction in which the lock member moves close to the lock position.

10. The image forming apparatus according to claim 1, wherein the slider connecting portion has a hollow cylindrical shape and extends in a perpendicular direction perpendicular to a direction in which the first housing and the second housing face each other, and wherein the arm connecting portion is formed at one end of the arm member nearer than another end of the arm member to the slider.

11. The image forming apparatus according to claim 3, wherein the restricting mechanism comprises:

a protruding portion disposed within a locus of the slide movement of the slider; and a lock member contactable with the slider, wherein the lock member is movable between a lock position in which at least a portion of the lock member is positioned in the locus of the slide movement of the slider and an unlock position in which the at least the portion of the lock member is positioned outside of the locus, and wherein, when the second housing is in the open position, the lock member is in the lock position.

12. The image forming apparatus according to claim 11, wherein the protruding portion and the lock member are overlapped with each other in a direction which is perpendicular to both of the slide moving direction and a direction in which the first housing and the second housing face each other when the second housing is in the closed position.

13. The image forming apparatus according to claim 1, wherein the first housing comprises an opening portion, and accommodates a cartridge configured to he detachable through the opening portion, and wherein the second housing serves as a cover that covers and uncovers the opening portion.

14. The image forming apparatus according to claim 1, wherein the first housing accommodates a photoconductive drum having a surface on which an electrostatic latent image is formed, and wherein the second housing comprises an exposure unit that exposes the photoconductive drum.

15. The image forming apparatus according to claim 1, wherein the second housing comprises an image scanning unit configured to scan an image recorded sheet in a portion of the second housing opposite to a portion of the second housing nearer to the first housing.

16. The image forming apparatus according to claim 1, wherein the housing connecting portion is disposed in a region nearer to a pivot point of the second housing in the slide moving direction of the slider than a position of the slider at a timing when the second housing is in the closed position.

17. The image forming apparatus according to claim 2, wherein the one of the first housing and the second housing comprises an extending portion extending from the rail portion in the slide moving direction of the slider, wherein the first engaging portion is disposed at one side of the rail portion while the housing connecting portion is disposed at another side of the rail portion, and wherein the second engaging portion is disposed at one side of the extending portion while the housing connecting portion is disposed at another side of the extending portion.

18. The image forming apparatus according to claim 1, wherein the slider is provided in the second housing.

19. A method of assembling an image forming apparatus including a first housing, a second housing configured to be pivotable relative to the first housing to be located to an open position and a closed position, the method comprising the steps of:

attaching an elastic member to one of the first housing and the second housing so that one end of the elastic member engages with a slider slidably provided in the one of the first housing and the second housing, and another end of the elastic member engages with the one of the first housing and the second housing;

pivotably connecting an end of an arm member to the slider;

pivotably attaching the second housing to the first housing; and connecting another end of the arm member to a housing connecting portion of the other of the first housing and the second housing in a state in which the second housing is pivotably attached to the first housing.

20. The image forming apparatus according to claim 1, wherein a slider hook is formed on the slider and engages with the first engaging portion of the elastic member.

* * * * *